US010163592B2

(12) United States Patent
Lane et al.

(10) Patent No.: US 10,163,592 B2
(45) Date of Patent: Dec. 25, 2018

(54) EQUIPMENT ISOLATION SWITCH ASSEMBLY

(71) Applicant: Remsafe Pty Ltd, Balcatta, Western Australia (AU)

(72) Inventors: Michael Charles Lane, Dianella (AU); Jack Mross, Fremantle (AU); Kazimierz Kacperek, Ocean Reef (AU)

(73) Assignee: REMSAFE PTY LTD., Balcatta (AU)

( * ) Notice: Subject to any disclaimer, the term of this patent is extended or adjusted under 35 U.S.C. 154(b) by 203 days.

(21) Appl. No.: 15/197,558

(22) Filed: Jun. 29, 2016

(65) Prior Publication Data

US 2017/0004942 A1 Jan. 5, 2017

(51) Int. Cl.

| | |
|---|---|
| ***H01H 27/06*** | (2006.01) |
| ***H01H 9/22*** | (2006.01) |
| ***H01H 9/28*** | (2006.01) |

(52) U.S. Cl.

CPC ..... *H01H 27/06* (2013.01); *H01H 9/282* (2013.01)

(58) Field of Classification Search

None

See application file for complete search history.

(56) References Cited

U.S. PATENT DOCUMENTS

| | | | | |
|---|---|---|---|---|
| 2,166,061 A | | 8/1937 | Kirk | |
| 3,798,398 A | * | 3/1974 | Hills | E05B 11/00 307/10.3 |
| 4,210,788 A | * | 7/1980 | Stranczek | H01H 9/28 200/320 |
| 4,863,006 A | | 9/1989 | Kotkata et al. | |

(Continued)

FOREIGN PATENT DOCUMENTS

| | | |
|---|---|---|
| AU | 2014100216 | 4/2014 |
| CN | 201376581 | 1/2010 |
| CN | 203027378 | 6/2013 |
| EP | 0400264 | 12/1990 |
| EP | 0553885 | 8/1993 |

(Continued)

OTHER PUBLICATIONS

Montague, Jim, "Mining, Minerals and Cement Forum: A Rich Vein of Automation Innovation," Control—Promoting Excellence in Process Automation, http://www.controlglobal.com/articles/2014/automation-fair-25, Nov. 21, 2014.

Ampcontrol, Inc., "Remote Isolation Increasing Personnel Safety and System Productivity," Nov. 2014.

Lane Mike, "Remote isolation of fixed plant using the innovative, safe and fast REMSAFE," ICM Technologies, Jul. 17, 2012.

Rockwell Automation Inc, ,"Adjustable Frequency AC Drives," Powerflex 4M Technical Data, 22F-TD001B-EN-P, literature.rockwellautomation.com/idc/groups/literature/documents/td/22ftd001_en_p.pdf, 1-20, Jun. 2013.

(Continued)

*Primary Examiner* — Jared Fureman
*Assistant Examiner* — Aqeel Bukhari
(74) *Attorney, Agent, or Firm* — Cislo & Thomas, LLP

(57) ABSTRACT

An equipment isolation switch assembly (200) for use in a remote isolation system (10) for isolating an equipment item (20,21) comprising an equipment isolation switch (400) movable between a first position (NORMAL) in which said equipment item (20,21) is energized by an energy source (30) and a second isolated position (ISOLATE) in which said equipment item (20,21) is isolated from said energy source (30) and an actuating device (500) co-operable with the equipment isolation switch (400) to move it between said first and second positions wherein said isolation switch assembly (200) includes at least one securing means (291, 405) for securing said actuating device (500) in co-operation with said equipment isolation switch (400) whenever in operative state.

22 Claims, 20 Drawing Sheets

(56) References Cited

U.S. PATENT DOCUMENTS

| | | | | |
|---|---|---|---|---|
| 6,442,452 | B1 | 8/2002 | Kopke | |
| 6,537,797 | B1 | 3/2003 | Picardal et al. | |
| 6,892,115 | B2 | 5/2005 | Berkcan et al. | |
| 7,151,329 | B2 | 12/2006 | Andarawis et al. | |
| 7,311,247 | B1 | 12/2007 | Lenner | |
| 7,340,311 | B2 | 3/2008 | Landis et al. | |
| 7,716,489 | B1 | 5/2010 | Brandt et al. | |
| 7,793,774 | B2 | 10/2010 | Cole et al. | |
| 8,364,292 | B2 | 1/2013 | Ebner | |
| 2003/0000358 | A1 | 1/2003 | Harris et al. | |
| 2003/0014779 | A1 | 1/2003 | Drotning | |
| 2005/0190056 | A1 | 9/2005 | Lacy et al. | |
| 2005/0253689 | A1 | 11/2005 | Mollet et al. | |
| 2008/0078658 | A1* | 4/2008 | Poyner | H01H 27/007 200/43.07 |
| 2008/0190749 | A1 | 8/2008 | Poyner et al. | |
| 2009/0140856 | A1 | 6/2009 | George et al. | |
| 2010/0030345 | A1 | 2/2010 | Cole et al. | |
| 2010/0085153 | A1 | 4/2010 | Smith | |
| 2013/0083805 | A1 | 4/2013 | Lu et al. | |
| 2013/0146427 | A1 | 6/2013 | Greirson | |
| 2013/0307694 | A1 | 11/2013 | Amar | |
| 2014/0111303 | A1 | 4/2014 | Scharnick | |
| 2014/0176303 | A1 | 6/2014 | Stratton et al. | |
| 2014/0283008 | A1 | 9/2014 | Daino et al. | |
| 2015/0091485 | A1 | 4/2015 | Lemberg et al. | |
| 2015/0108840 | A1* | 4/2015 | Lane | G05B 9/02 307/31 |

FOREIGN PATENT DOCUMENTS

| | | |
|---|---|---|
| EP | 1502893 | 2/2005 |
| EP | 1821264 | 8/2007 |
| EP | 2367190 | 9/2011 |
| EP | 2637068 | 9/2013 |
| EP | 2842149 | 3/2015 |
| GB | 263960 | 1/1927 |
| JP | H06144764 | 5/1994 |
| WO | WO 2011/031410 | 3/2011 |
| WO | WO 2011/047428 | 4/2011 |
| WO | WO 2012/142674 | 10/2012 |
| WO | WO 2013/160275 | 10/2013 |

OTHER PUBLICATIONS

Rockwell Automation Inc, "Powertlex 20-HIM-A6 and 20-HIM-C6S HIM (Human Interface Model)," User Manual, rockwellautomation.com/idc/groups/literature/documents/um/20him-um001_-enp.pdf, 1-74, Feb. 2013.

Rockwell Automation, "Protective Measures and Complementary Equipment—Trapped Key Interlocks" web.archive.org/web/20150315070238/http://www.ab.com/en/epub/catalogs/3377539/5866177/3378076/7131359/Trapped-Key-Interlocks.html, 1-1-1-78, Mar. 15, 2015.

Allen Bradley, "Prosafe Trapped Key Systems—Easy Selection Guide," http://www.nhp.com.au/files/editor_upload/File/Brochures/Business-Specific/easyselectionguides/NHPNTUPROTRAPABESG.pdf, 1-12, Feb. 2015.

* cited by examiner

EQUIPMENT ISOLATION SWITCH ASSEMBLY

This invention relates to an equipment isolation switch assembly, in particular for use in remote isolation systems.

Various types of equipment must be isolated from a range of energy sources including electrical energy (the most common) and mechanical energy including pressure and potential energy to enable safe maintenance and other work to be carried out. For example, conveyor belt systems used in the mining industry for transporting iron ore or other bulk materials can span significant distances. These distances can be in the range of many kilometers. Such conveyors are typically powered by electric drive motors: three phase electrical power is supplied wherein the voltage may range from low voltage ranges (from below 600V to 1000V AC), to medium and high voltage ranges (in the multiple kV range and extending to above 10 kV AC and even 33 kV AC). Such conveyors typically include brake systems which are also electrically operated.

Although different mine procedures and relevant safety standards may apply, a typical pre-requisite before permitting mechanical maintenance or other activity involving access to the conveyor belt system involves the electrical isolation of the conveyor system. This isolation ensures that the energy source powering the conveyor belts and associated equipment, i.e. electrical power, is removed from systems that—if energised—could cause a safety hazard. It will however be understood that equipment items other than conveyor systems also require isolation for maintenance and other purposes.

The isolation process is invariably safety critical and has, in the past, been time consuming, as described for example in the introduction to the Applicant's granted Australian Patent No. 2010310881 and International Publication No. WO 2012/142674, the contents of which are hereby incorporated herein by reference.

The remote isolation system described in Australian Patent No. 2010310881 enables equipment isolation to be requested at a remote isolation station associated with the equipment and subsequently approved through a plant control system, without mandatory visitation to the equipment by authorized isolation personnel. This remote isolation system significantly reduces time for achieving safe isolation, especially production downtime which can be very costly.

The remote isolation station includes an isolation switch means which must be switched to isolated mode subsequent to an isolation approval being received. The isolation switch means must also be locked, by a locking means, into the isolated mode thereby preventing re-energisation of purposefully isolated equipment. This is called a manual lock out system and current Western Australian mining regulations require lockout, applying a hasp then a personal lock on the hasp, to the isolation switch which is provided with a specific aperture for this lockout purpose.

An issue that may arise with lock attachment of this nature is that personnel may misunderstand the correct location for attaching the hasp and attach it incorrectly to the wrong part of the isolation switch.

The above discussion assumes use of a manual lock out system. However, other mechanically or electrically operable locking devices may become available in the future and the Applicant also seeks to address future potential issues with mis-application of such locking devices to the isolation switch.

It would be desirable to provide an isolation switch that minimises, or more preferably eliminates, the risk of mis-application of locking devices during the isolation procedure.

With this object in view, the present invention provides an equipment isolation switch assembly for use in a remote isolation system for remotely isolating an equipment item comprising:

an equipment isolation switch movable between a first position in which said equipment item is energised by an energy source and a second isolated position in which said equipment item is isolated from said energy source; and an actuating device co-operable with the equipment isolation switch to move it between said first and second positions;

wherein said isolation switch assembly includes at least one securing means for securing said actuating device in co-operation with said equipment isolation switch whenever in operative state.

The equipment isolation switch assembly is advantageously configured to enable deactivation, for example where a user of the Applicant's remote isolation system decides to select an alternative isolation procedure under particular equipment operating conditions or where a control system of the remote isolation system indicates that selection of an alternative isolation procedure is required. Deactivation to a maintenance or bypass mode also permits maintenance of the equipment isolation switch and the remote isolation system. In case of deactivation, the securing means is removed allowing the actuating device, such as a removable key, to be removed from co-operation with the equipment isolation switch.

Such removal of the actuating device is permitted by the equipment isolation switch only when the associated equipment item(s) is (are) in normal position, not the isolated position. Such deactivation may also require other tasks to be completed before a remote isolation system is safely and completely removed from service. For example, completion of such tasks may involve the use of other keys, preferably rendered operable using a key exchange unit such as that described in the Applicant's Australian Provisional Patent Application No. 2015902557 filed on 30 Jun. 2015, the contents of which are hereby incorporated herein by reference. In embodiments such as this, the actuating device, such as a key, is multi-functional being used to implement additional tasks in the isolation system to just actuating the equipment isolation switch.

Conveniently, the actuating device is a key for moving the equipment isolation switch between the first and second positions to isolate equipment. Such key is typically a mechanical device (though other devices including electronic devices and signals could be used). Where mechanical keys are used, the switch module may take the same form as a conventional lock, for example a cylinder-lock working on a pin and tumbler principle. For reasons described above, the key is desirably both unique to the equipment isolation switch and removable under prescribed circumstances, the key circumstance being a requirement for deactivation of the equipment isolation.

The equipment isolation switch may be comprised within a replaceable switch module, a feature which is particularly advantageous under certain circumstances. For example, safety is a paramount consideration and, for this reason, it is undesirable to provide duplicate actuating devices with it instead being highly preferable for a unique actuating device to be provided to co-operate with any equipment isolation switch. Accordingly, if the actuating device is lost or stolen from the switch, even if intended to be removable under prescribed circumstances described below, replication is avoided and no replacement is available. Rather, the switch module is replaced with a substitute switch module including its corresponding actuating device following any required authorisation procedure. The original switch module may then be refurbished with a substitute actuating device in a manner with substantially lesser risk than encountered with duplicate actuating devices.

The securing means would be a mechanical or electronic means, or a combination of these which holds the equipment isolation switch and actuating device in co-operation through operation of a control system for the remote isolation system whenever the equipment isolation switch is operative.

The securing means may hold the actuating device in co-operation with the equipment isolation switch through operation of a control system for the remote isolation system. For example, the control system may prevent the actuating device from disengaging from co-operation with the switch unless specific conditions, such as faults, arise. The actuating device, such as a key, may be held captive to the switch—for example by mechanical interlock—unless the securing means is removed under control system authority. The control system could also prevent removal of any mechanical securing means such as the keeper plate described below.

The isolation switch requires to be locked out to complete equipment isolation. Currently, the lockout process is a manual process requiring application of a locking device such as a hasp and personal lock to the isolation switch, though electronic devices, such as smart cards, may be used in the future, for example as described in the Applicant's Australian Provisional Patent Application Nos. 2015902559 and 2015902564 each filed on 30 Jun. 2015, the contents of which are hereby incorporated herein by way of reference.

The above described isolation switch advantageously should not permit lockout unless the above mentioned control system for the remote isolation system electronically implements co-operation between the isolation switch and locking device in line with a series of permissives, which desirably involves completion of a logical sequence of requirements, selected to prevent hazardous release of energy from the equipment item following isolation. Importantly, this means, amongst other benefits, that personnel cannot complete the required lockout process by misapplication of a manual lock to an apparent lockout point or, by analogy, by way of some other form of locking device.

A preferred series of permissives would involve a first try start step involving attempted restart of the equipment item. Successful completion of this try start step actually involves a failure to restart the equipment item. A second step in the sequence, subsequent to successful completion of the try start step, would involve actuation of the securing means. Both steps are controlled by the control system of the remote isolation system.

In a preferred embodiment suitable for a manual lockout arrangement, the equipment isolation switch comprises a securing means including a plurality of lock members engageable to form a lockout point when permitted by the control system. Two such lock members are preferred, each configured with portions co-operable, when permitted by the control system, to form the required lock out point. Such portions may be in the form of cut outs, such as slots, which co-operate to form an aperture providing the isolation lockout point. A first lock member may be a fixed portion of the equipment isolation switch, possibly forming part of the exterior of the equipment isolation switch housing. A further lock member may be configured to be inoperable, for example being held captive at a desired location, until the control system authorises lockout. To reiterate, control system lockout authorisation is dependent on the correct isolation procedure involving successful completion of a series of permissives such as that described above being followed.

The further lock member may be held captive to the housing of the equipment isolation switch, for example by magnetic force (such as induced by a solenoid) or mechanical interlock. When the control system authorises a lockout, the further lock member is released, thereby being actuated through movement into co-operation with the first lock member to together form the aperture which provides the required lock out point.

Preferably, the equipment isolation switch assembly securing means comprises a plate lock member which, when positioned for isolation, partially or wholly covers the isolation switch to prevent it being moved from the isolated position. In such a case, the plate forms the further lock member and an additional securing means. The plate is connected to a hinge only operable to allow the plate to rotate into co-operation with the first lock member when authorised by the control system following completion of the correct isolation procedure.

Where a mechanical key is used, it typically requires to be inserted to activate the equipment isolation switch. Equipment isolation switches tend however to be subject to environmental factors, such as vibrations emanating from equipment or caused by climatic conditions. Such vibration could cause the key to be lost from the switch. Misuse or error might also result in key loss. To avoid loss in circumstances such as this, a retaining or keeper plate may be installed as part of the equipment isolation switch assembly following insertion of the key into the switch, the plate having an aperture through which a portion of the key extends for manual operation between the first and second positions. However, the aperture has insufficient dimension to allow removal of the key once the keeper plate has engaged the key. The keeper plate may itself be locked into position by a lock preventing unauthorised removal.

The position of the further lock member is preferably monitored by sensors and the control system for correct positioning whether for isolated and de-isolated states. An alert signal may issue where there is any variation from such correct positioning. Tampering with a locked out equipment isolation switch may also be monitored by sensors provided for the purpose.

The equipment isolation switch is advantageously employed in the Applicant's remote isolation systems which include a control system for approving isolation on permissible request logged by an operator at a remote isolation station. Such systems are described, for example, in Australian Patent No. 2010310881 and the Applicant's Australian Provisional Patent Application Nos. 2015902556, 2015902557, 2015902558, 2015902559, 2015902561, 2015902562, 2015902564 and 2015902566 each filed on 30 Jun. 2015, the contents of which are hereby incorporated herein by way of reference.

More preferably, the equipment isolation switch is integrated with the remote isolation station which also includes the required control panel and interface for effecting equipment isolation requests. The remote isolation station may be in a fixed position or may be configured to be mobile to suit specific applications. A plurality of remote isolation stations may also be provided for an equipment item. Where a remote isolation station is arranged to be mobile, for example in the form of a portable computer device or communication device using wireless communications, it will likely be possible to reduce the number of remote isolation stations well below that conveniently employed using fixed remote isolation stations.

Lockout of the equipment isolation switch, for instance at the above described remote isolation station may release an additional actuating device, such as a key, or equipment item for use in, or following, an isolation procedure. Such actuating device may be used to operate a specific equipment item and/or to access a particular area off limits other than when equipment is isolated. For example, barriers such as gates or doors may be locked during normal equipment operating conditions but when the equipment isolation switch is locked out, a key for removing the barrier, such as by opening a gate or door, is released enabling equipment maintenance.

The equipment isolation switch may be included in any desired remote isolation system, beneficially being included in new remote isolation systems or retrofitted to existing isolation systems, especially those remote isolation systems disclosed and/or supplied by the Applicant. Such remote isolation systems may be used in a range of applications including in the materials handling and mining industries. The equipment isolation switch assembly may also advantageously be used for isolating rail system components in railway infrastructure.

The term "isolation" as used in this specification is to be understood in its maintenance engineering and legal sense as not simply turning off a supply of energy to equipment, whatever the nature of that energy, but removing and/or dissipating energy to provide a safe work environment as required by applicable occupational health and safety regulations. In the case of electricity, as just one example, isolation is not achieved simply by turning off a power supply to the equipment. In such cases, the equipment could accidentally re-start or be restarted and cause injury to personnel, or worse. Isolation instead prevents such accidental re-starting and typically will also involve processes to dissipate any hazardous stored energy, in whatever form that energy may take (e.g. potential energy), from the equipment. For example, such an additional energy dissipation step could be effected in respect of a conveyor belt system by way of the braking cycle procedure as described in the Applicant's Australian Provisional Patent Application No. 2015902565, the contents of which are incorporated herein by way of reference.

The equipment isolation switch assembly of the present invention may be more fully understood from the following description of a preferred embodiment made with reference to the following drawings in which.

Figure 1:
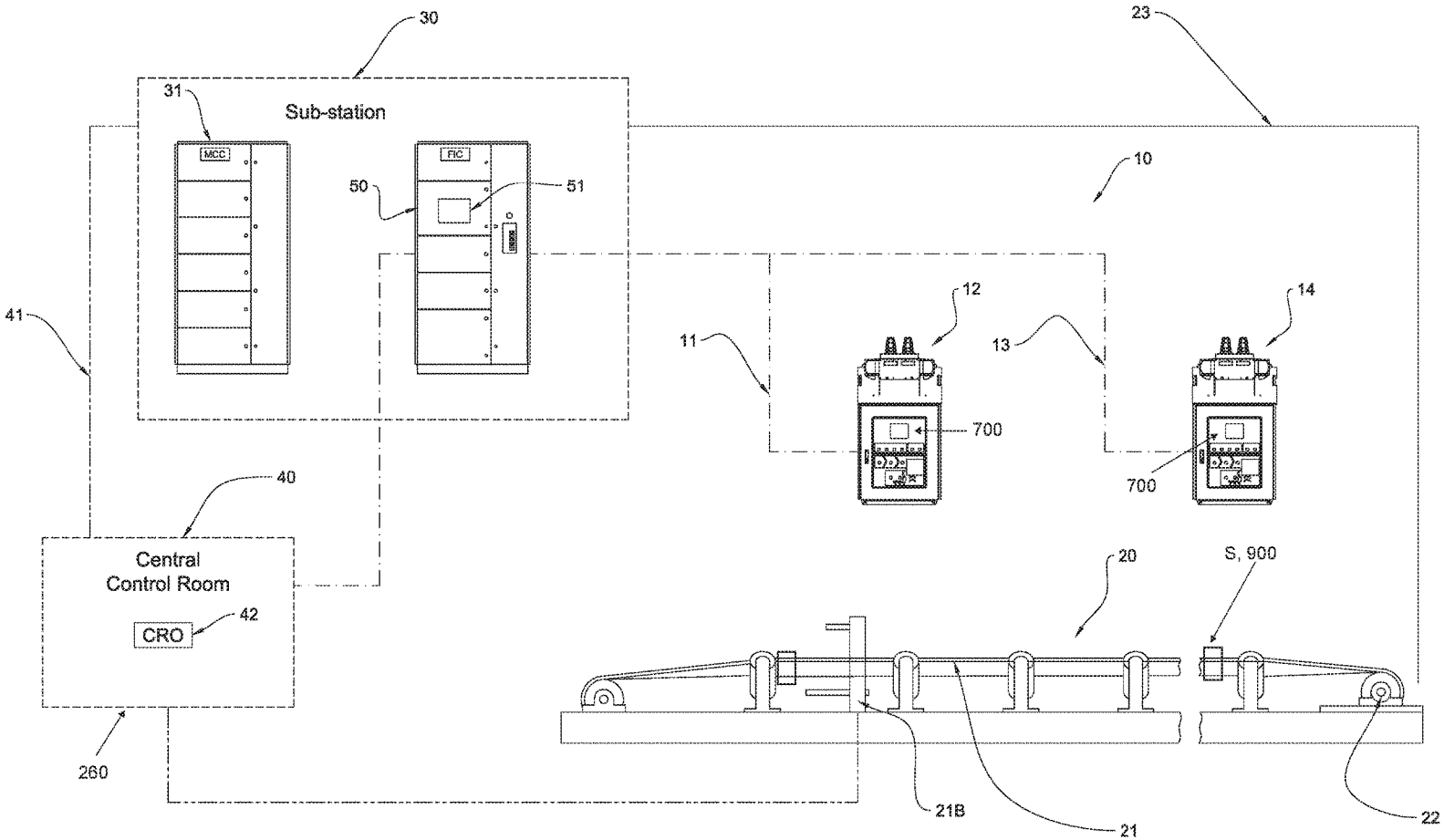
FIG. 1 shows a schematic layout of a remote isolation system as applied to a conveyor belt system and including the equipment isolation switch assembly of one embodiment of the present invention.

Referring to FIG. 1, there is shown a schematic layout of a remote isolation system 10, as retrofitted on to an existing conveyor belt system 20, for example a long range overland conveyor system for conveying iron ore from a mine site to a port for shipment. The conveyor belt system 20 comprises a troughed conveyor belt 21 having a head pulley motor 22 driven by an electrical supply emanating from electrical contacts 31, whether provided as contactors or circuit breakers. One contact is a standard contactor for "ON"/"OFF" operation of the motor 22. The head pulley motor 22 is powered through a variable speed drive (VSD) which is electrically powered from a 3 phase AC power supply line 23 providing voltages of less than 1000V AC. The electrical power is supplied from a sub-station 30. The sub-station 30 houses the contacts 31. Activation of the contacts 31 (i.e.

placing them in the "off" or "break" state), de-energises all 3 phases of the electrical supply to the conveyor head pulley drive motor 22. Such de-energisation is continuously monitored by a voltage monitor relay (not shown) located downstream of contacts 31, i.e. on the conveyor belt system 20 side of the contacts 31.

The conveyor belt system 20 also includes a Tramp Metal Detector (TMD) 21 B for detecting tramp metal which requires removal to avoid damage to the conveyor belt 21. Prior to removal of tramp metal, the conveyor belt system 20 requires isolation, as described below, to make removal safer.

The conveyor belt system 20 and sub-station 30 are under the control and supervision of a plant control system 260 having a central control room (CCR) 40, via a DCS (Distributed Control System), a PLC (Programmable Logic Controller) and a SCADA (Supervisory Control and Data Acquisition System) as are commonly used and would be well understood by the skilled person. Item 41 in FIG. 1 is representative of a communication and control network between the CCR 40 and various other plant systems and components. A Control Room Operator (CRO) 42 is located within the CCR 40 and has various input/output (I/O) devices and displays available (not shown) for the proper supervision and control of the conveyor belt system 20. Except for the remote isolation system 10, the above description represents what may be considered a conventional system in the materials handling and mining industries.

The remote isolation system 10 comprises fixed remote isolation stations 12 and 14 which are located proximate to the conveyor belt system 20. It will be understood that remote isolation stations 12 and 14 could be replaced or supplemented by one or more mobile isolation stations, for example in the form of a portable computer devices (in certain applications these potentially being provided as smartphones) or communication devices using wireless communications as disclosed for example in the Applicant's Australian Provisional Patent Application Nos. 2015902561 and 2015902562 , the contents of which are incorporated herein by reference. The remote isolation stations 12 and 14 may be powered from the plant grid, other power networks or alternative power sources, conveniently such as solar power.

The remote isolation system 10 also includes a master controller 50 incorporating a human/machine interface (HMI) in the form of a touch sensitive screen 51 which displays human interpretable information. The master controller 50 is also located within sub-station 30. Remote isolation stations 12 and 14 are in communication with master controller 50 and each other via communication channels 11 and 13. These communication channels can be provided in any suitable form including hard wired or wireless forms with an open communications protocol. Ethernet communications are particularly preferred to enable flexible system updating on site if needed. Communications must be via safety rated communications protocol software such as Interbus Safety or PROFIsafe which are well known within the mining and materials handling industries. This will ensure that the communication channels are monitored and diagnostic tools are available for fault control and rectification when required.

Further description of the electrical layout and operation of the remote isolation system 10 is provided in the Applicant's granted Australian Patent No. 2010310881, the contents of which are incorporated herein by reference. In summary, the conveyor belt system 20 is isolated by a process involving the following sequence of steps:

- Operator request for control system to approve isolation of all or part of the conveyor belt system 20 including conveyor 21 and drive motor 22 in accordance with a preferred mode of isolation developed by the Applicant and described in Australian Provisional Patent Application No. 2015902558, the contents of which are incorporated herein by reference;
- Isolation approved if operator request meets permissives for isolation, for example as described in Australian Patent No. 2010310881;
- Isolation automatically implemented;
- Try step process being invoked to check that the isolation is effective, which involves checking that electrical contacts 31 for the conveyor belt system 20 are in isolated position with no voltage being detected by the voltage monitor relay downstream of the electrical contacts 31 (and desirably, conveyor belt movement sensors such as movement speed sensor S and/or belt standstill monitor 900 confirming that the conveyor belt 21 has come to a complete stop as described below); an attempt to re-start the conveyor belt system 20 using try step button or an automated process; and checking that there is no re-energisation of conveyor belt system 20 (which may involve monitoring as described in the Applicant's Australian Provisional Patent Application No. 2015902556, the contents of which are incorporated herein by reference); and
- Lockout at a control panel of remote isolation station 12 and/or 14 if the try step process is unsuccessful (as desired) and related stored energy tests show that, for all practical safety purposes, energy has been dissipated from the conveyor belt system 20 and the remote isolation system 10 can proceed to isolate.

Figure 2:
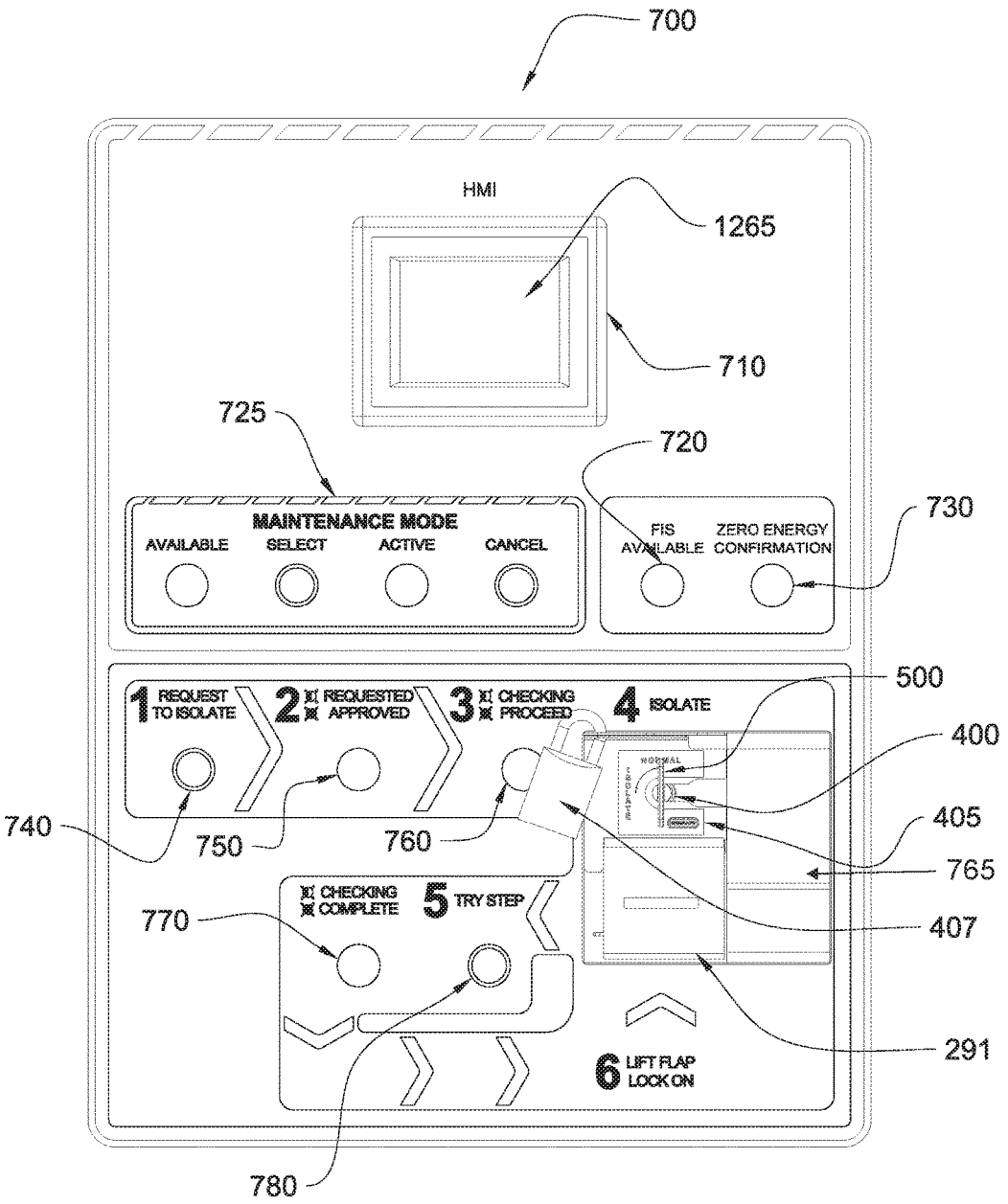
FIG. 2 shows a schematic of a control panel for use in the remote isolation system schematised in FIG. 1, the control panel integrating the equipment isolation switch of one embodiment of the present invention.

FIG. 2 shows a schematic of a control panel 700 arranged as part of each of remote isolation stations 12 and 14 for implementing the Applicants remote isolation system. Panel 700 has a human machine interface (HMI) 710 with a touch screen 1265 (though less fragile buttons, switches and other input devices may be used in alternative arrangements) for entering commands, including issuing isolation requests to the plant control system. Request button 740 is provided for instigating isolation requests, whilst information can also be presented on screen 1265 in respect of any such isolation requests including isolation status and plant data.

Control panel 700 also includes:

- indicator light 720 showing whether or not the remote isolation station (RIS) 12 or 14 is available for isolation;
- indicator light block 725 showing whether or not exclusive or maintenance mode for the remote isolation system is active as described in Australian Provisional Patent Application No. 2015902557 (with the remote isolation station 12 exclusively controlling operation of the conveyor belt system 20), the contents of which are incorporated herein by reference; and respective "select" and "cancel" buttons for initiating or terminating the maintenance mode;
- Indicator light 730 to provide zero energy confirmation when sensors, such as at least the load voltage monitor relay described above for contacts 31 and preferably conveyor belt 21 movement sensors as well, indicate zero hazardous energy in the conveyor belt system 20 (i.e. a zero energy indication is achieved when the culmination of all energy sources being monitored confirms that there is no stored or latent energy (whether potential, or electrical etc) remaining in the system desired to be isolated);

- request isolation button 740 which is activated by an operator to request isolation and "request approved" indicator light 750 which illuminates to provide status information to said operator;
- indicator light block 760 for showing correctness of selection of the conveyor belt 21 for isolation and for indicating that control system checking is taking place subsequent to an isolation request being instigated;
- indicator light block 770 for showing whether or not the isolation process is complete following control system checking; and
- graphics (in the form of arrows and text) illustrating the sequence of steps to be followed in the required isolation procedure.

Control panel 700 also includes an equipment isolation switch block 765 which prevents completion of the isolation process by locking with an operator's personal lock at isolation switch 400 until the correct remote isolation procedure, for example as described in Australian Patent No. 2010310881 has been completed. In particular, a correct remote isolation procedure requires a try start step to be completed by an operator by activation of a try step button 780 before any manual lock out is possible. The equipment isolation switch 400 is designed to prevent any such manual lock out before the correct isolation procedure has been completed.

The try step is essentially a means by which an isolation can be proved by attempting a plant start. Failure of the plant to start can be considered as confirmation that an operator has isolated the correct plant or equipment item. The operations that occur when a try step is performed may vary from site to site and application to application, but by way of example, the control system can provide the following actions when the try step button 780 is pressed:—

- simultaneously or sequentially activation as may be required to attempt all possible starts for that plant such as soft start activation via SCADA, including the various modes such as manual & auto, and other hard wired starts such as via field start pushbuttons; and
- checks of the positions of all devices/equipment to be isolated and the energy status, or presence of energy, in these and other devices/equipment (e.g. checking for belt standstill, brake pressure, isolator position, voltage present etc).

FIGS. 3, 5 to 14, 15C and 16 show the equipment isolation switch assembly in the form of an isolation switch box 200 required for use to achieve isolation of conveyor belt 21. Switch box 200 has a housing 220 which includes equipment isolation switch 400 at the front. Housing 220 includes an upper flange 230, a lock member in the form of a magnetically operated mechanical interlock flap 291 and a resting portion 240 against which flap 291 is held captive when required (as will be described further below). Importantly, housing 220 is free of apparent lockout points to which a personal lock could be inadvertently fixed when employing a manual lockout procedure.

Figure 16:
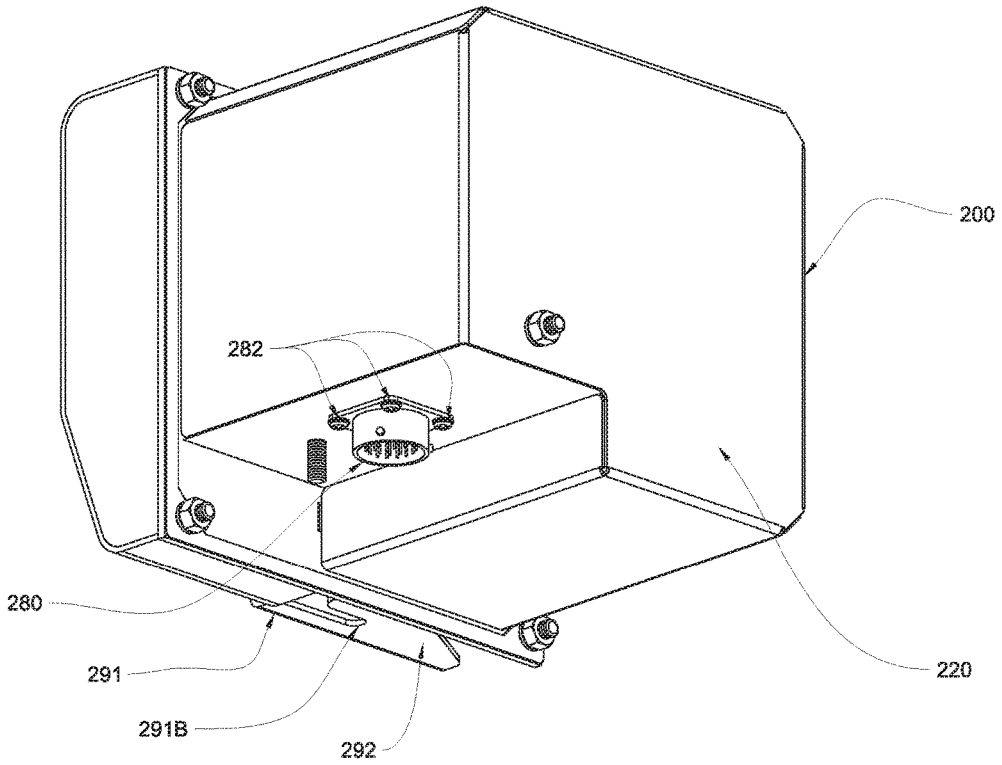
FIG. 16 shows a bottom perspective view of the equipment isolation switch assembly shown in FIGS. 3 and 5 to 9 in normal condition.

Housing 220 also accommodates, noting its interior as well as exterior, electrical and mechanical components and systems to enable operation of the isolation switch box 200. Power and communications cables are connected through socket 280 (detachable by removing screws 282) as shown in FIG. 16. Access to interior components, for example by removing an access cover 294, is restricted to authorized personnel. Housing 220 has robust construction being configured and designed to endure difficult environmental conditions typical of remote mine sites.

Equipment isolation switch 400 must co-operate with a switch actuating device, which in this embodiment is provided in the form of key 500 whenever remote isolation system 10 is operative, i.e. available to achieve remote isolation. Key 500 is shown in greater detail in FIG. 18 and has an outer portion 510 and a body portion 515 formed with a number of notches 520, the purpose of which will be described below. Importantly, the equipment associated with the remote isolation system cannot be locked out or isolated without the key 500 being in place to actuate the isolation switch.

For various reasons, including vibration of the switch box 200 or misuse, there is some risk that key 500 could be lost from equipment isolation switch 400. To minimise such risks, the equipment isolation switch assembly 200 includes at least one securing means to secure the key 500 into co-operation with equipment isolation switch 400 whenever it is operative, not necessarily in isolated condition as will be apparent from description below.

Figure 4:
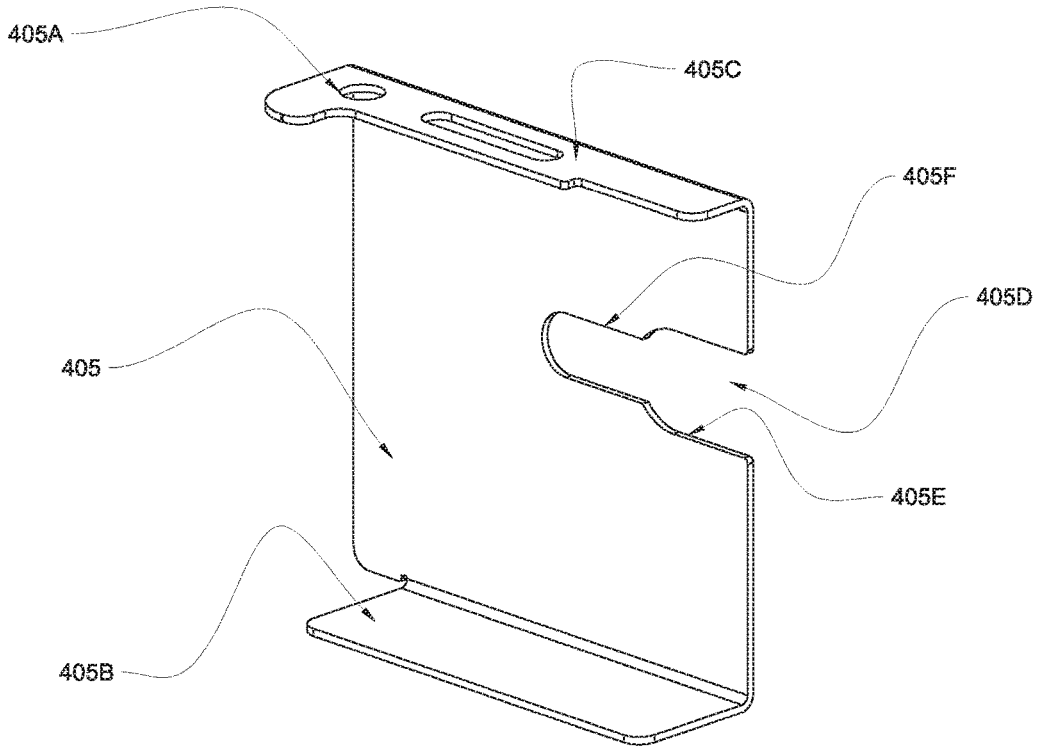
FIG. 4 shows a perspective view of the keeper plate of FIG. 3.

A first such securing means is provided by retaining (keeper) plate 405 which is designed to prevent removal of key 500 from equipment isolation switch 400 once locked into position. Keeper plate 405 is shown as a separate component in FIG. 4 and includes lower flange 405B and upper flange 405C. Upper flange 405C includes an aperture 405A to accommodate a lock device (padlock 407) to secure the keeper plate 405 to the switch box housing 220. Keeper plate 405 includes an open ended aperture 405D comprising two slot portions 405E and 405F, portion 405F having lesser height than that of portion 405G and the diameter of isolation switch 400. Aperture 405D has a terminal portion 405G at one end of slot portion 405F. The function of these features is described below.

Keeper plate 405 has dimensions allowing a neat fit between upper surface 240A of magnetic portion 240 (with which lower flange 405B of keeper plate 405 is in contact) and upper flange 230 (with which upper flange 4050 of keeper plate 405 is in contact) of switch box housing 220.

Figure 3:
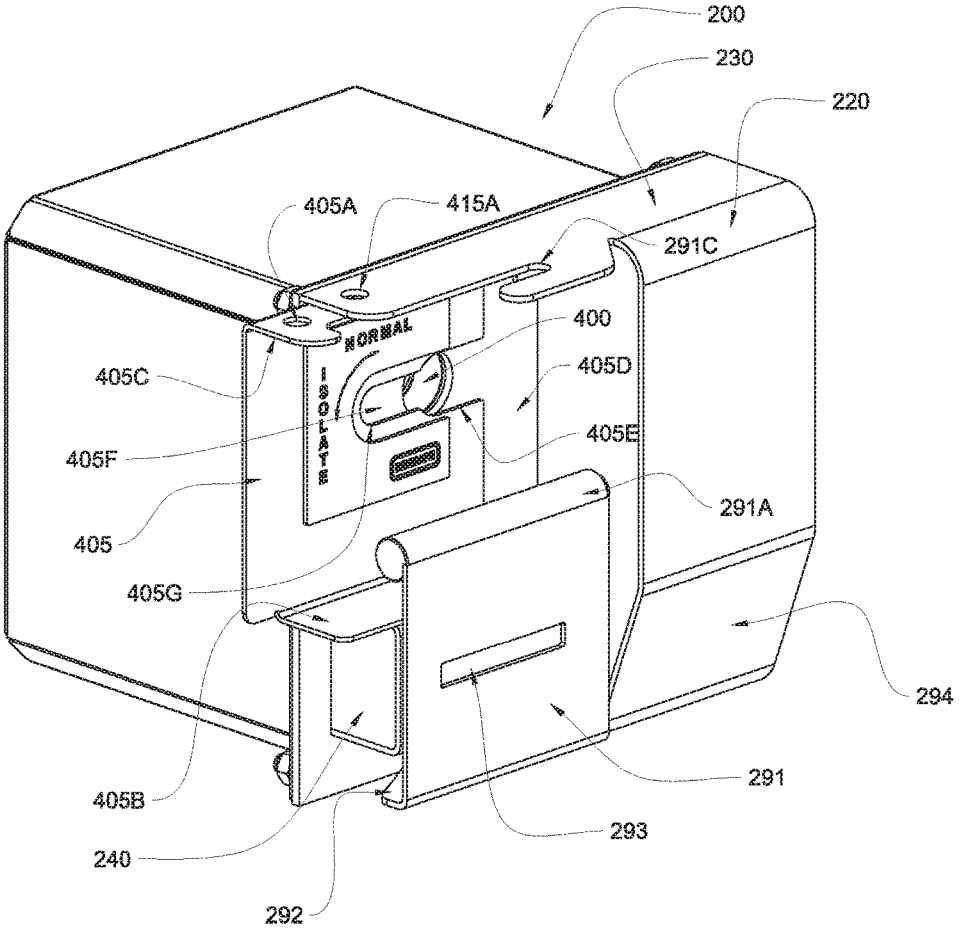
FIG. 3 shows a front left perspective view of the isolation switch included within the control panel of FIG. 2 in inoperative condition and being prepared for use with a retaining (keeper) plate securing means being moved into position for preventing removal of a key actuating device when installed.
Figure 5:
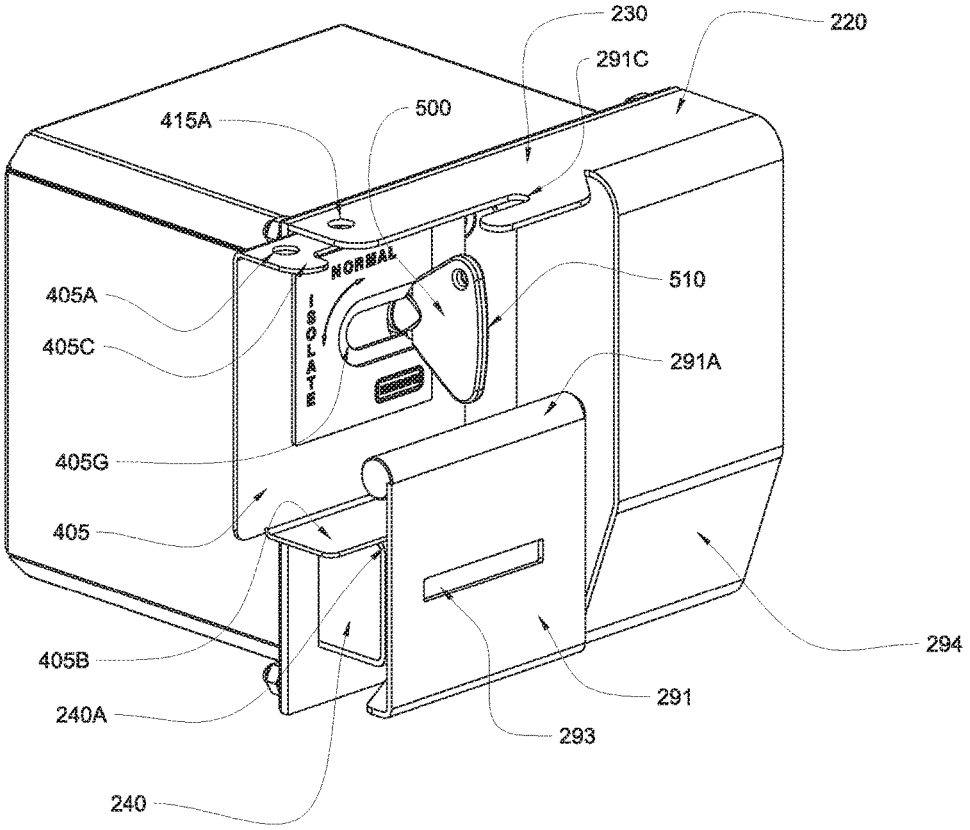
FIG. 5 shows a front perspective view of the equipment isolation switch assembly of FIG. 3 in a normal condition with key installed and keeper plate being moved into position for securing the key.
Figure 6:
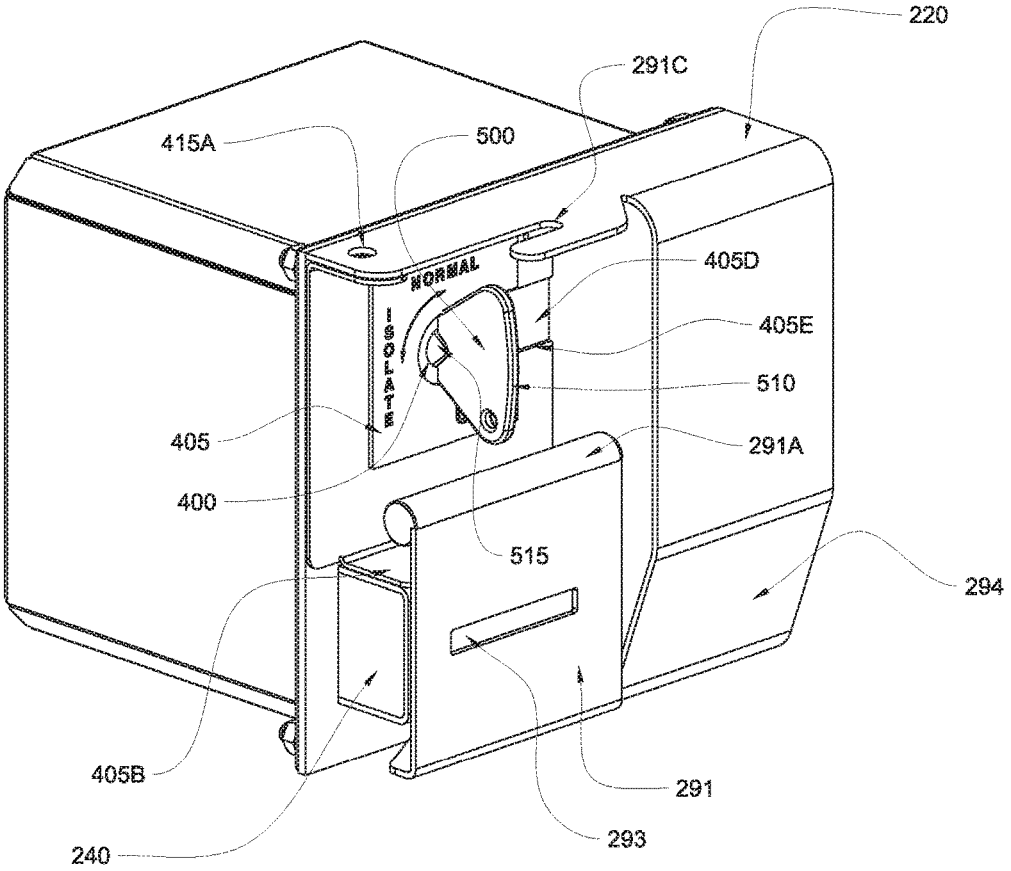
FIG. 6 shows a front perspective view of the equipment isolation switch assembly showing key installed in the equipment isolation switch with the keeper plate in position, once locked, to prevent key removal.
Figure 7:
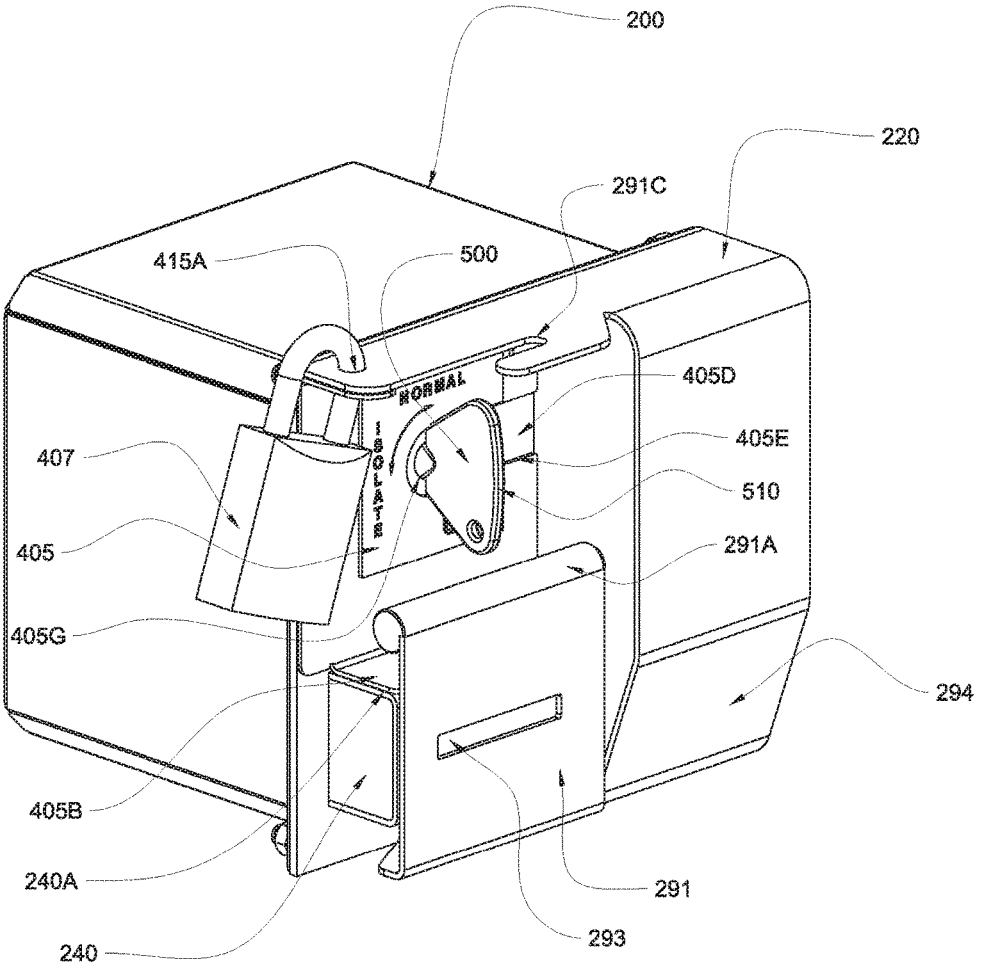
FIG. 7 shows a first front perspective view of the equipment isolation switch assembly showing key installed in the equipment isolation switch with the keeper plate locked into position to prevent key removal.

Installation of keeper plate 405 will now be described with reference to FIGS. 3 and 5 to 7. Keeper plate 405 is slid into a first position between magnetic portion 240 and upper flange 230 of switch box housing 220 as shown in FIG. 3. In this position, slot portion 405E is co-located with equipment isolation switch 400 and key 500, having lesser dimension for its body portion 515 than slot 405E such that it may readily be inserted and brought into co-operation with switch 400 (FIG. 5). Keeper plate 405 is slid further into a position, as shown in FIG. 6, where terminal portion 405G of slot portion 405F engages with key portion 515 whilst overlapping with switch 400. The relative dimensions of key portion 515 and slot portion 405F now enable keeper plate 405 to prevent removal of key 500 from switch 400. In this position, aperture 405A of keeper plate 405 aligns with corresponding aperture 415A of upper flange 230 of switch box housing 220 forming a locking point for padlock 407. The keeper plate 405 is now locked into position as shown in FIG. 7. In a further embodiment, aimed at making unauthorised key removal even more difficult, the key 500 may be machined with slots locating and securing it to the keeper plate 405.

Equipment isolation switch 400 is now operable by turning the key 500 between a first "NORMAL" position in which the drive motor 22 for the conveyor 21 is electrically energised (i.e. not isolated) and a second "ISOLATE" position in which the drive motor 22 is electrically isolated and thus without power thereby facilitating any maintenance works which may be required. That is, the isolation switch 400 maintains the isolated position/status of the isolators when rotated to the ISOLATE position, and when rotated or returned to the NORMAL position, de-isolation occurs.

However, whilst turning the key 500 from the NORMAL to the ISOLATE position is a necessary step in establishing an isolation state when authorised by master controller 50, this alone does not provide a sufficient condition for the remote isolation system to isolate the conveyor belt 21 and its drive motor 22. Importantly, the equipment isolation switch 400 must be locked out, in this case, by a manual lockout procedure. Further, manual lockout is not provided for by equipment isolation switch 400 unless a lockout point is provided by co-operating a locking device with the isolation switch 400 under the control of master controller 50. Authorisation of manual lockout by the master controller 50 requires the correct remote isolation procedure sequence to have been be completed as summarised above and as described in detail for example in the Applicant's Australian Patent No. 2010310881.

Figure 13:
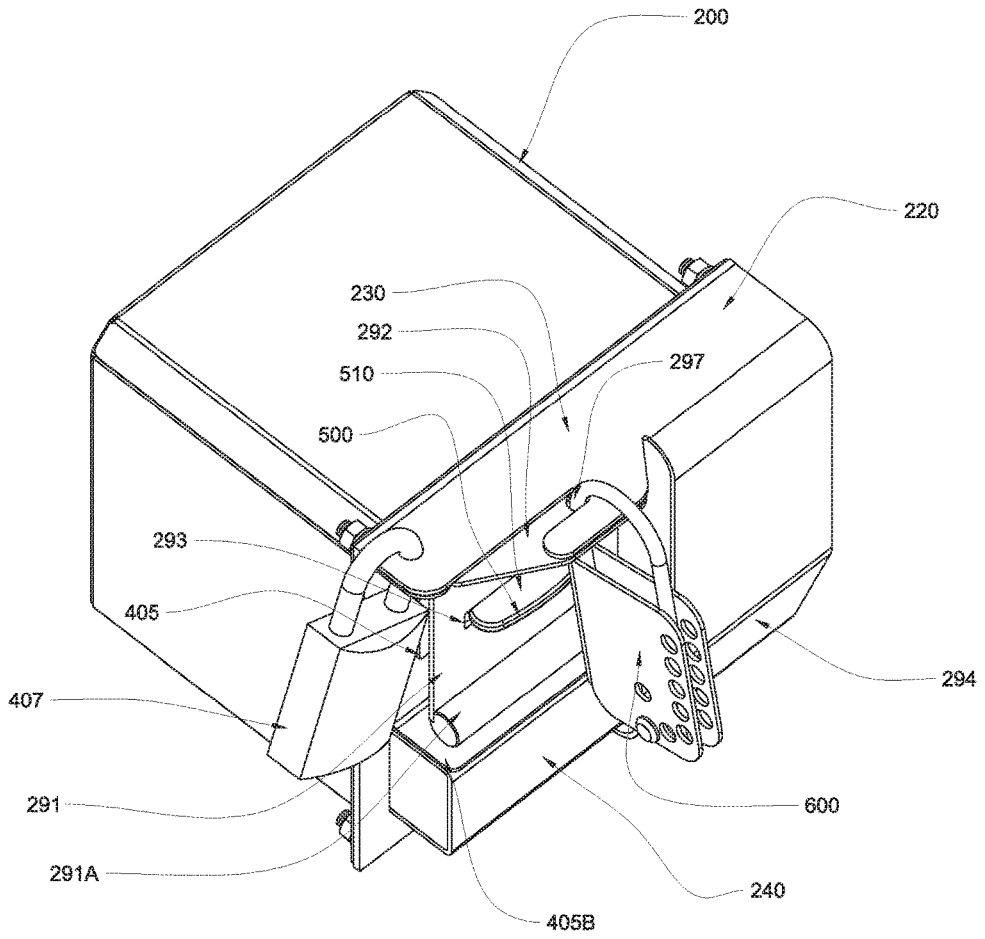
FIG. 13 shows a top perspective view of the equipment isolation switch assembly shown in FIGS. 3 and 5 to 12 with the lock members and hasp in a locked out position.
Figure 14:
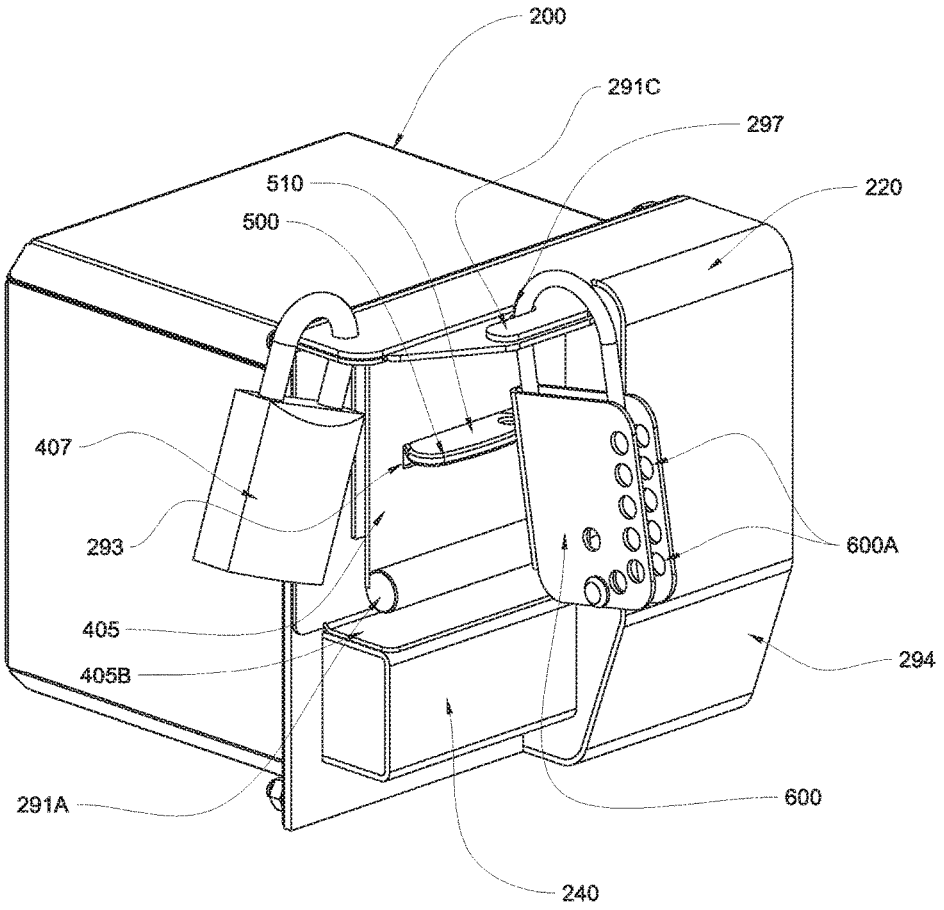
FIG. 14 shows a front perspective view of the equipment isolation switch assembly shown in FIGS. 3 and 5 to 13 with the lock members and hasp in a locked out position.

The locking device for equipment isolation switch 400 has two lock members, the first being formed by cut out or slot 291C located in a fixed position top flange 230 of the switch housing 220. Slot 291C would alone not typically accommodate a locked padlock or hasp as required for a regulatory governed isolation. The second lock member is configured as a plate or flap 291 which has a cut out or slot 291B arranged at one end of flange 292 which corresponds with the cut out or slot 291C when the flap 291 is raised to cover the key switch 400. The cut out or slot 291C is also designed to alone not support attachment of a hasp or personal lock 600 thereto. The flap 291 also includes a central slot 293 arranged to correspond with the outer end 510 of the key 500 when the flap 291 is raised to cover the isolation switch 400. The slot 293 and flap 291 are designed with dimensions such that they alone cannot co-operate with a hasp 600 (as depicted in FIGS. 13 and 14) as typically used with the remote isolation system.

Figure 12:
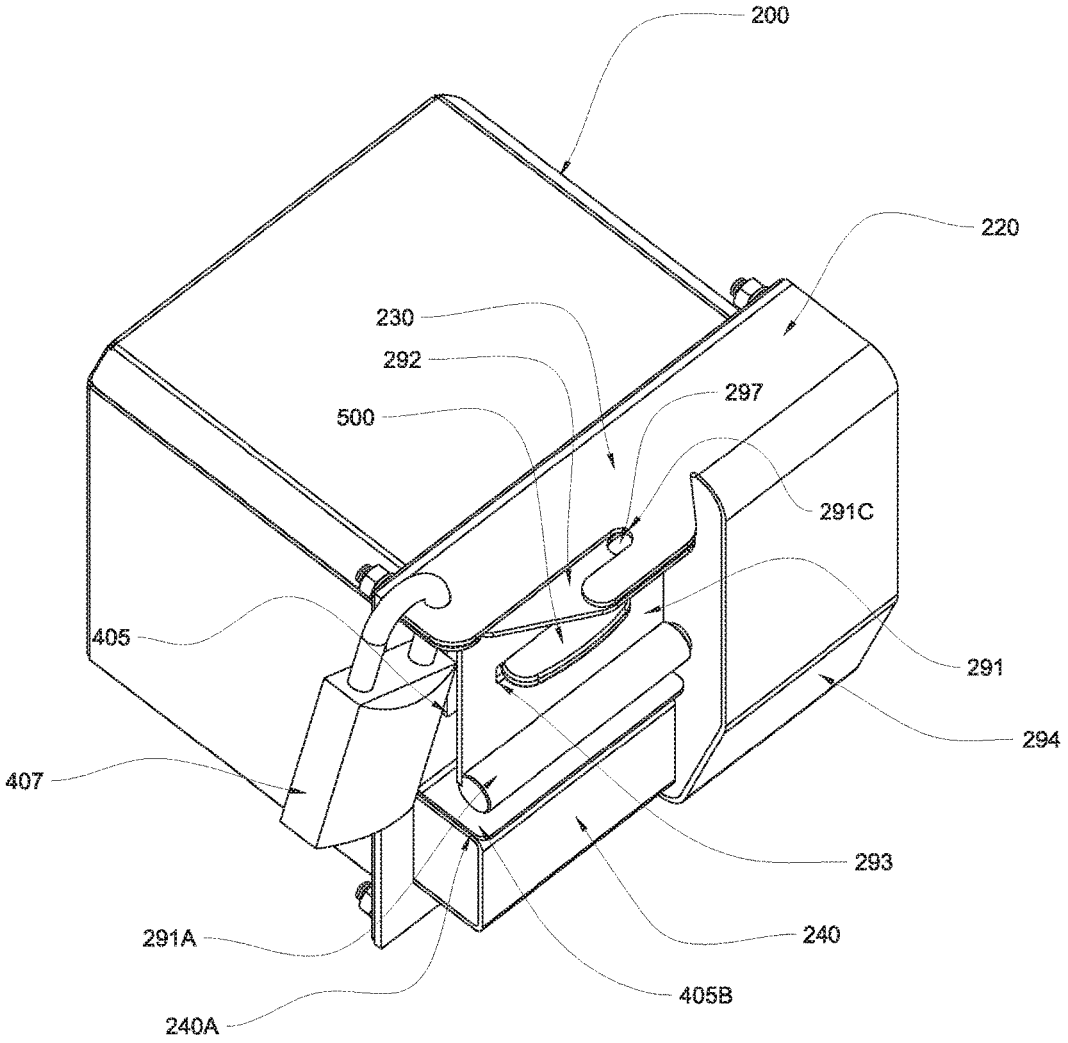
FIG. 12 shows a top perspective view of the equipment isolation switch assembly shown in FIGS. 3 and 5 to 11 with the lock members in lockout position ready for a hasp to be applied.

The lock members 291 (and in particular its slot 291B) and 2910 will only be allowed to co-operate to form a lockout point 297 (as best depicted in FIG. 12) through co-operation if authorised by master controller 50, and this will only occur if the correct remote isolation procedure (as summarised above) is initially followed.

Figure 8:
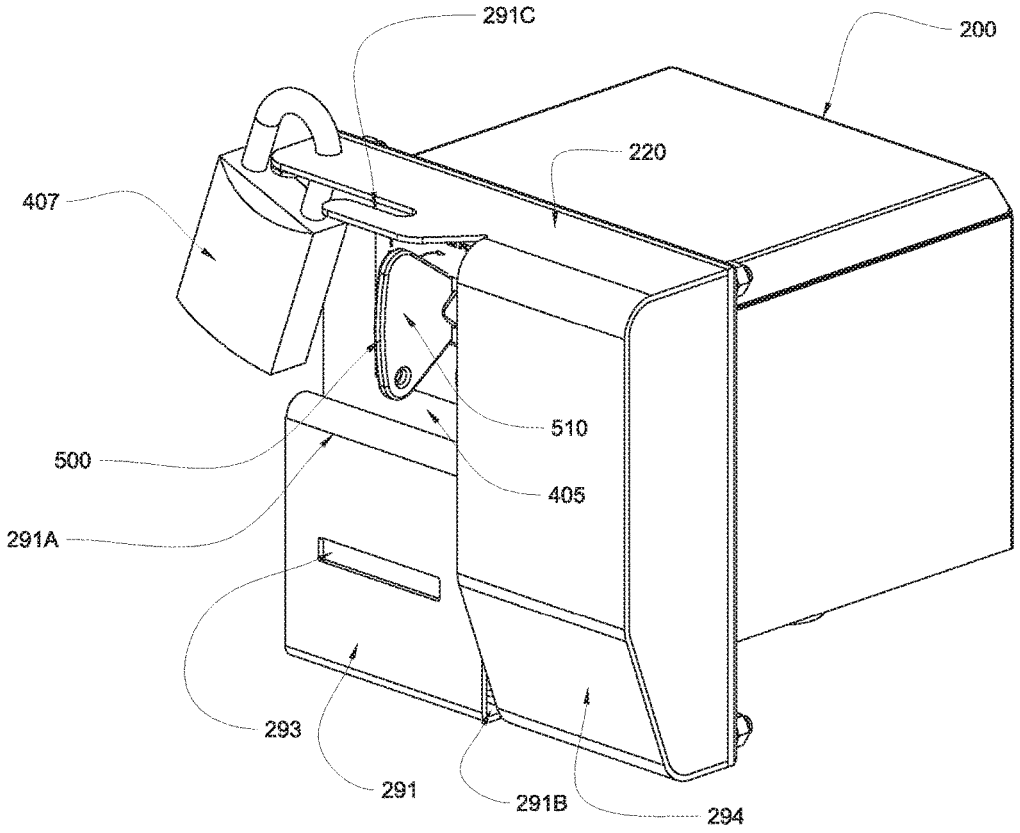
FIG. 8 shows a second front perspective view of the equipment isolation switch assembly of FIGS. 3 and 5 to 7.

As shown in FIGS. 2, 7 and 8, the equipment isolation switch 200 and particularly the isolation switch 400 are initially in a "resting" state with flap 291 and slot 293 (for accommodating the key 500 when it is in the isolated position) open and held captive against resting portion 240 of switch box 200 through a solenoid operated magnetic interlock as described below.

Figure 9:
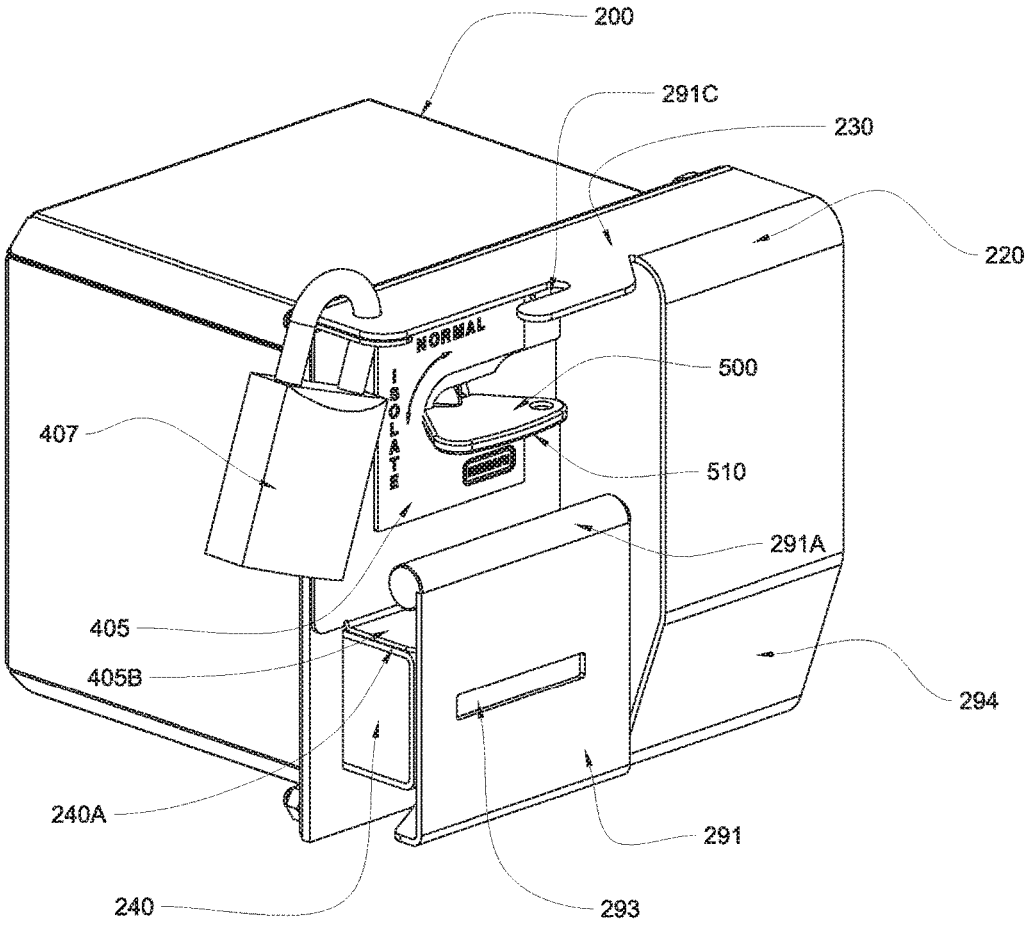
FIG. 9 shows a front perspective view of the equipment isolation switch assembly later with the key moved to ISOLATE position prior to lockout.
Figure 10:
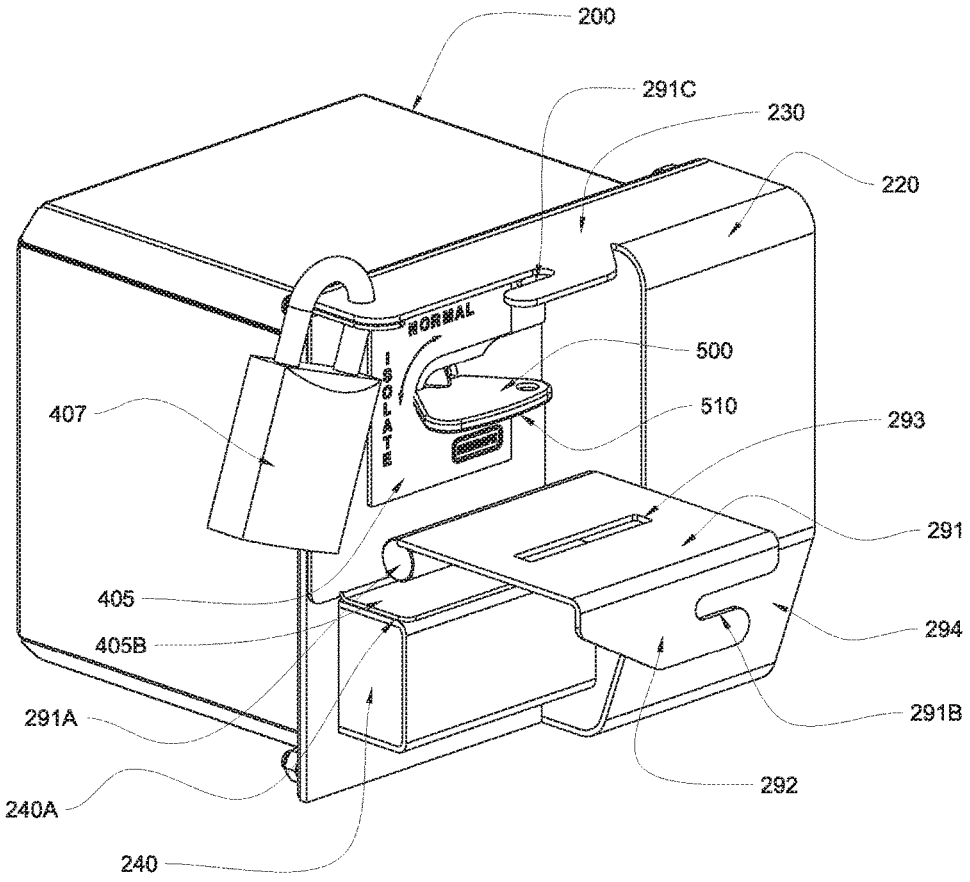
FIG. 10 shows a front perspective view of the equipment isolation switch assembly shown in FIGS. 3 and 5 to 8 with a movable lock member being moved into lockout position to prevent switch movement from the ISOLATE position.
Figure 11:
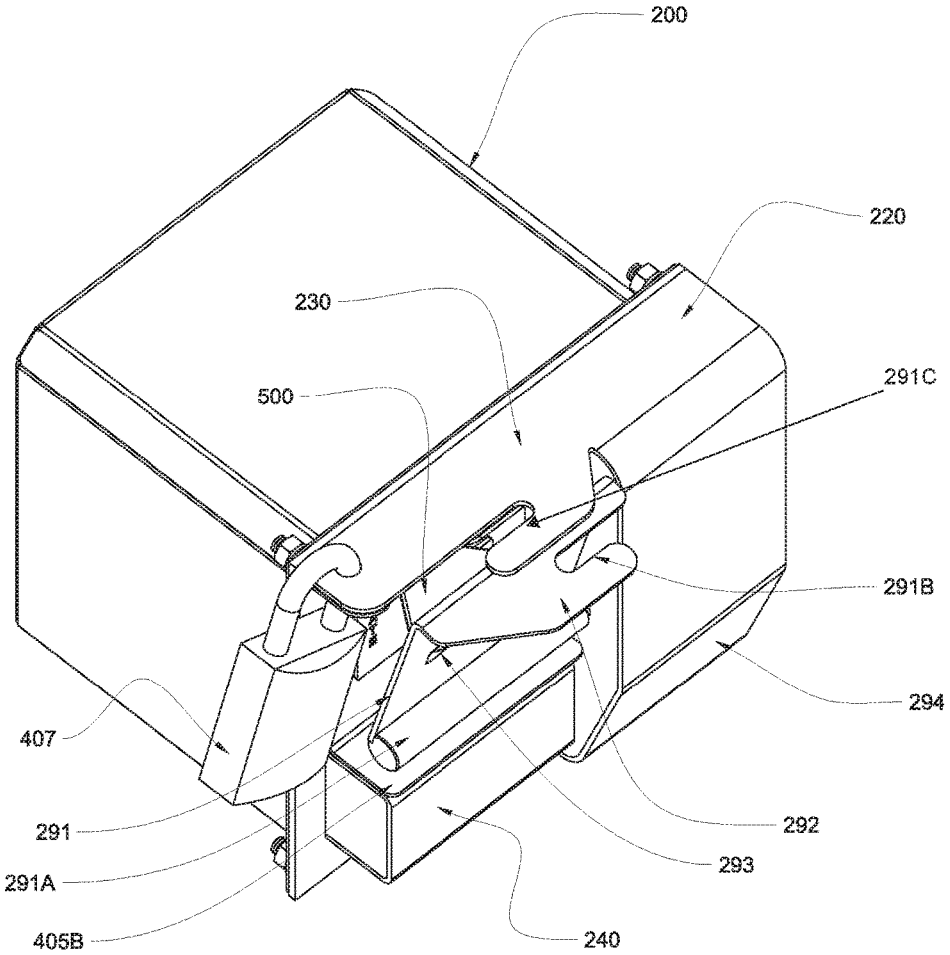
FIG. 11 shows a top perspective view of the equipment isolation switch assembly shown in FIGS. 3 and 5 to 9 with the movable lock members almost in lockout position.

When isolation is authorised following correct procedure and key 500 is turned to the second ISOLATE position (as shown in FIG. 9), flap 291 is released from its captive position enabling it to rotate about its hinge 291A and flap shaft 310. This happens because a magnetic lock preventing rotation of hinge 291A is de-magnetised, on isolation, due to deactivation of the flap solenoid 301. This enables flap 291 to rotate upward in clockwise direction (as indicated by FIGS. 10 to 12, 15A and 15B) and finally into the locking position as shown in FIGS. 12 to 14.

Figure 15A:
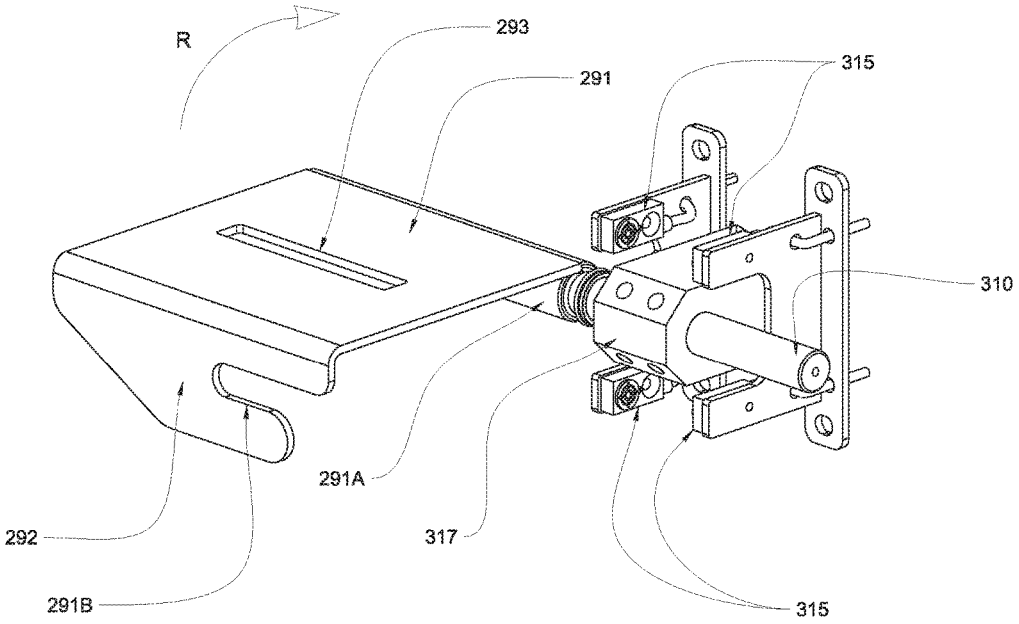
FIGS. 15A and 15B show detailed perspective views illustrating the arrangement and movement of a movable lock member for the equipment isolation switch assembly shown in FIGS. 3 and 5 to 14.
Figure 15B:
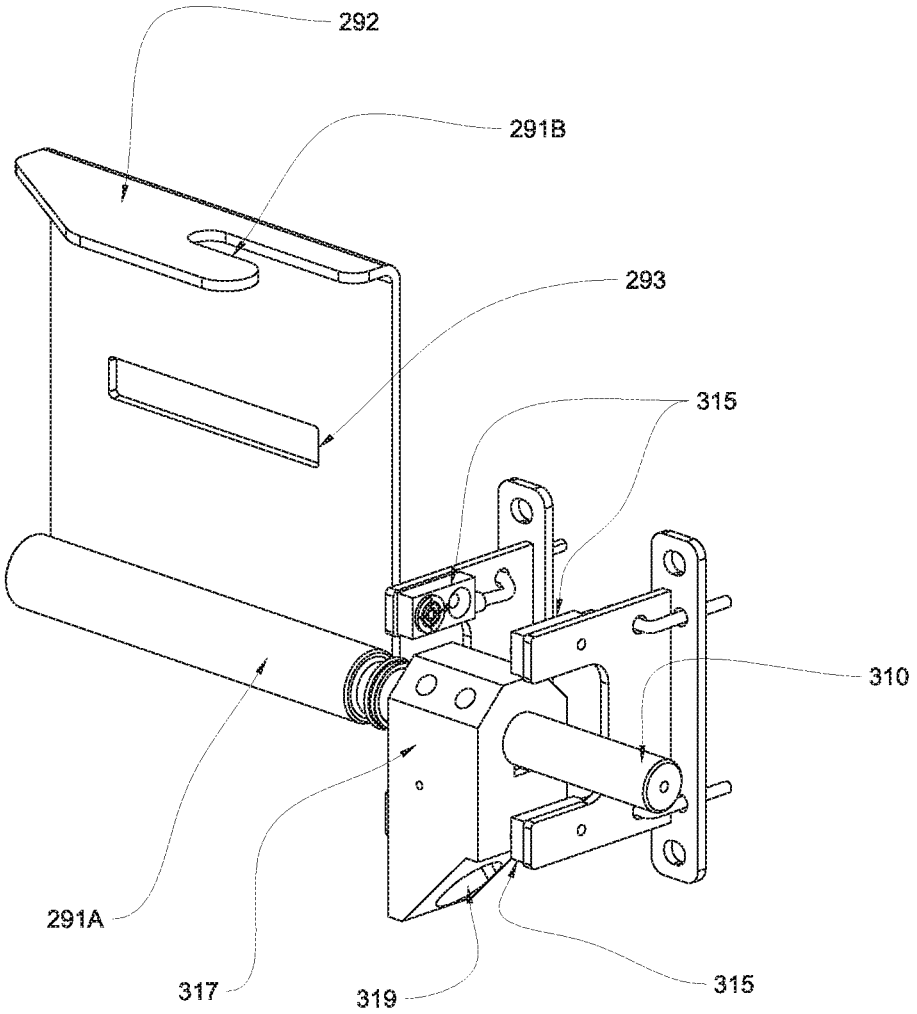
Figure 15C:
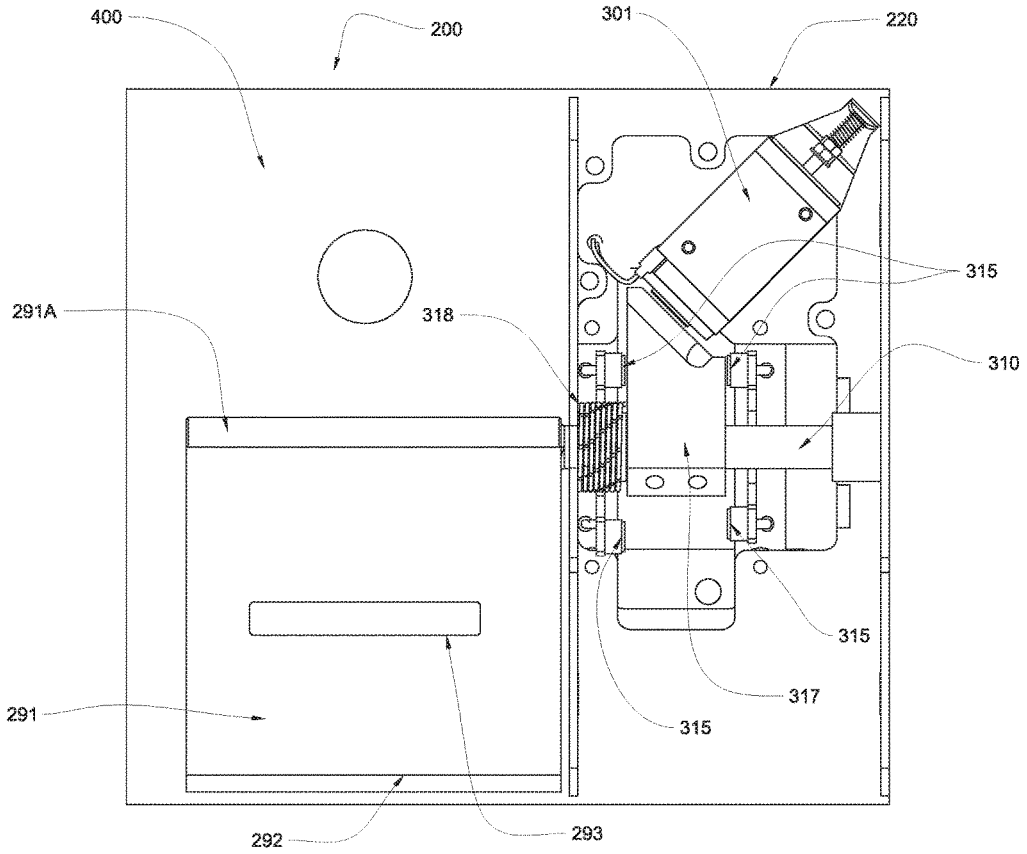
FIG. 15C shows a partial front view of an equipment isolation switch assembly shown in FIGS. 3 and 5 to 14 with cover removed to show the lock member arrangement in position within the switch box.

Further detail of the solenoid operated mechanical interlock is shown in FIGS. 15A to 15C, noting that FIG. 15C is a partial view omitting details of the isolation switch 400, replacing it with a general reference to isolation switch location 400'. In a "resting" position, flap solenoid 301 is energised by power supply to the switch box 200. A plunger portion of the flap solenoid 301 is consequently located within a receptacle 319 of striker/positioning block 317 and this acts as a lock on rotation of flap shaft 310. Flap 291 is held captive. Proximity sensors 315 monitor the position and generate an alarm signal if the flap 291 moves unexpectedly from the captive position. On isolation, the plunger portion of solenoid 301 is released from receptacle 319 of striker/positioning block 317. The lock is released and flap shaft 310, hinge 291A and flap 291 allowed to rotate (as indicated by R in FIG. 15A) into the locking position against the action of flap shaft return spring 318. Proximity sensors 315 also detect this situation.

In locking position, flap 291 covers the isolation switch 400 though providing for the outer end 510 of the key 500 to extend through slot 293. When this occurs, slots 291B and 291C co-operate to form an aperture 297 or lockout point through which a hasp 600 is securely and correctly accommodated for lockout as shown in FIGS. 13 and 14. This prevents movement or removal of key 500 from isolation switch 400 and acts as a second key securing means. More than one operator may lockout and hasp 600 includes a number of apertures 600A allowing other personal locks to be applied.

The master controller 50 of the remote isolation system properly deactivates flap solenoid 301 enabling lockout to occur as above described only when an unsuccessful try step (i.e. attempt to restart conveyor belt system 20) is first completed. Until that point, flap 291 is held captive in its resting position as best seen in FIGS. 7 and 8.

Sensors, such as proximity sensors similar to sensors 315 described above, are used to monitor the position of the key 500 in isolation switch 400 and to ensure that various components (e.g. key 500, keeper plate 405 and flap 291 (through sensors 315)) are correctly positioned when the system is in a "resting" or NORMAL (energised) state or a "locked out" or "ISOLATE" condition. Corrective action may be initiated if deviation from the correct position is indicated. The system can also be configured to generate alert signals if such a scenario were to occur. Sensors can also be arranged to indicate any tampering with the flap 291 such that corrective action may be initiated if any tampering is detected.

Upon correct de-isolation being initiated, the flap 291 is rotated back to its resting position to again be held captive against resting block 240 through operation of the solenoid actuated magnetic interlock.

The equipment isolation switch 400 is only operable when the key 500 is engaged with it. Equally, the key 500 must be removed from the isolation switch 400 when deactivation of the equipment isolation switch 200 is required. Control system or authorised personnel approval would be required prior to any such removal which, even then, is only permitted when the isolation switch 400 is in the NORMAL condition. Importantly, key removal is not permitted without additional validation steps if the key switch 400 is in the ISOLATE condition. Deactivation would typically require other tasks to be completed before a remote isolation system is safely and completely removed from service and the equipment item in question can be re-energised for normal operation. Completion of such tasks may involve the use of other keys, preferably rendered operable using the key exchange unit described in the Applicant's Australian Provisional Patent Application No. 2015902557, the contents of which are incorporated herein by reference.

Figure 17:
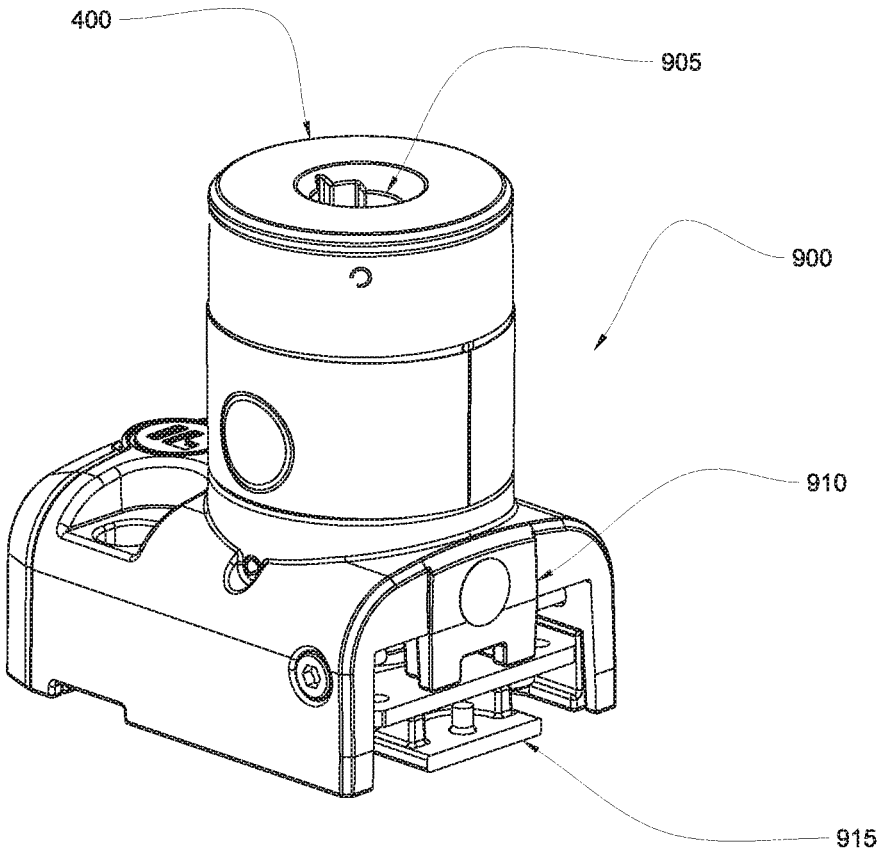
FIG. 17 shows a replaceable module including the switch of the equipment isolation switch assembly shown in FIGS. 3, 5 to 14, 15C and 16.
Figure 18:
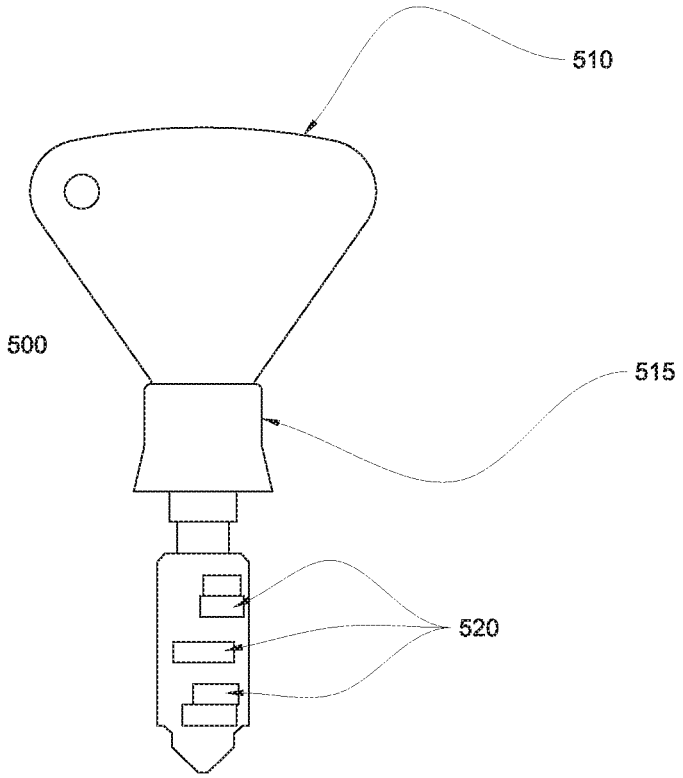
FIG. 18 shows a key used for activating or deactivating the equipment isolation switch.

A further embodiment of the invention is now described with reference to FIGS. 17 and 18. Isolation switch 400 may be comprised within a replaceable switch module advantageous under certain circumstances. Plant safety is a paramount consideration and, for this reason, it is undesirable to provide duplicate keys 500 to operate isolation switch 400. Key 500 is provided with a specific unique configuration of notches 520 which will only allow actuation of the illustrated isolation switch 400 for example by actuating pins within a cylinder of isolation switch 400 using a pin and tumbler lock principle. Accordingly, if key 500 is lost from the switch, for example during an isolation system deactivation or bypass, no replacement is available.

However, in such circumstances, a module including isolation switch 400 may be removed and replaced with a substitute switch module 900 including its corresponding actuating device following any required authorisation procedure. Switch module 900 includes a cylinder or barrel 905 including the isolation switch 400 and a latch portion 910 including the switch locking mechanism 915. A key (not shown) but having different configuration of notches than key 500 would also be provided. Barrel 905 also includes a different pin arrangement to the former switch module. However, both switch modules conveniently work on the known pin and tumbler principle which is accordingly not described further here.

The original switch module may then be refurbished with a substitute key 500 (but with a different arrangement of notches 520) in a manner with substantially lesser risk than encountered when duplicate keys, including master keys, are provided.

Application of the isolation switch assembly as described above ensures that isolators do not de-energise, and that a lock flap associated with the isolation switch 400 is held captive until all isolation steps are verified, hence preventing any personal locks being attached until isolation is confirmed and safe maintenance or work conditions are confirmed. Importantly, no lock points are provided on the isolation switch 400 or switch box 200 until an isolation has been effected.

Furthermore, the isolation switch assembly facilitates a desirable two-stage process required to achieve lock-out by an operator and hence provides an additional level of safety for the operator of the remote isolation system, Specifically, if a try step attempt to start the plant after a request to isolate is approved (i.e. restarting of the plant is unsuccessful as desired), the isolation switch 400 is then able to be turned to an ISOLATE position. When actuated, the isolation switch subsequently results in de-energisation of the solenoid which retains the lock-out flap 291 which can then be rotated into engagement with the isolation switch 400 and key 500 and in turn provide the required lockout point for the operator.

Modifications and variations to the equipment isolation switch of the present invention may be apparent to the skilled reader of this disclosure. Such modifications and variations are deemed within the scope of the present invention. For example, the above discussion refers to isolation of conveyor belt systems at mine sites by isolating conveyor belt drive motors from an electrical energy supply. It will be understood however that different equipment may be isolated from different energy sources using the equipment isolation switch described herein.

Furthermore, while the control panel 700 has primarily been described as including a human machine interface (HMI) 710 with a touch screen 1265 and a series of buttons and lights (e.g. 740, 750, 760, 770, 780 etc) to enable an operator to request an isolation event, it should be noted that the control panel 700, and specifically the touch screen 1265, may be configured to provide greater control and more information about isolation system steps to an operator (or indeed full control and all information to do with the isolation system). That is, a more 'digitally' based input means (or indeed a totally digital system) may be arranged for operation instead of an analogue or part analogue system as described herein to enable control of the equipment isolation system according to the present invention.

The invention claimed is:

1. An equipment isolation switch assembly for use in a remote isolation system for remotely isolating an equipment item comprising:

an equipment isolation switch movable between a first position in which said equipment item remains energized by an energy source and a second isolated position causing said equipment item to be isolated from said energy source;

an actuating device co-operable with the equipment isolation switch to move it between said first and second positions after approval of the isolation request by the control system on satisfaction of a series of permissives for an isolation process;

wherein said isolation switch assembly includes at least one securing means for securing said actuating device in co-operation with said equipment isolation switch whenever in operative state; and wherein said equipment isolation switch assembly is configured to enable deactivation of the equipment isolation switch on removal of the actuating device from co-operation with the equipment isolation switch.

2. An equipment isolation switch assembly as claimed in claim 1 wherein said actuating device is a removable key.

3. An equipment isolation switch assembly as claimed in claim 1 wherein said actuating device is multi-functional being used to implement additional tasks in the isolation system to actuating the equipment isolation switch.

4. An equipment isolation switch assembly as claimed in claim 1 wherein said actuating device is unique for the equipment isolation switch.

5. An equipment isolation switch assembly as claimed in claim 4 wherein said switch assembly comprises a replaceable switch module requiring replacement in case of loss of the actuating device.

6. An equipment isolation switch assembly as claimed in claim 1 wherein said securing means holds the actuating device in co-operation with the equipment isolation switch through operation of a control system for the remote isolation system.

7. An equipment isolation switch assembly as claimed in claim 6 wherein said control system prevents the actuating device from disengaging from co-operation with the switch unless specific conditions arise.

8. An equipment isolation switch assembly as claimed in claim 6 wherein said actuating device is held captive to the switch unless the securing means is removed when permitted by said control system.

9. An equipment isolation switch assembly as claimed in claim 1 wherein said equipment isolation switch does not permit lockout by a locking device unless a control system for the remote isolation system electronically implements co-operation between the equipment isolation switch and locking device in line with a series of permissives selected to prevent hazardous release of energy from the equipment item following isolation.

10. Art equipment isolation switch assembly as claimed in claim 9 wherein said series of permissives involves a first try start step involving failure of an attempted restart of the equipment item and a second step involving actuation of the securing means following said failed restart attempt, both steps being controlled by the control system.

11. An equipment isolation switch assembly as claimed in claim 1 wherein said securing means forms an isolation lockout point when permitted by the control system for the remote isolation system.

12. An equipment isolation switch assembly as claimed in claim 11 wherein said plurality of lock members includes a first lock member forming part of a housing of said equipment isolation switch and a further lock member held captive to the housing of the equipment isolation switch until, when the control system authorises a lockout, the further lock member is released, thereby being actuated through movement into co-operation with the first lock member to together form an aperture which provides a required lock out point.

13. An equipment isolation switch assembly as claimed in claim 12 wherein said further lock member of said securing means comprises a plate lock member which, when positioned for isolation, partially or wholly covers the isolation switch to prevent it being moved from the isolated position.

14. An equipment isolation switch assembly as claimed in claim 13 wherein said actuating device is a mechanical key and a retaining or keeper plate is installed as part of the equipment isolation switch assembly following insertion of the key into the switch, the plate having an aperture through which a portion of the key extends for manual operation between the first and second positions, said aperture having insufficient dimension to allow removal of the key once the keeper plate is installed.

15. An equipment isolation switch assembly as claimed in claim 14 wherein said keeper plate is locked into position by a lock preventing unauthorised removal.

16. An equipment isolation switch assembly as claimed in claim 12 including sensors for monitoring position of said further lock member and issuing an alert signal where there is any variation from correct positioning.

17. An equipment isolation switch assembly as claimed in claim 12 including sensors for monitoring for tampering with a locked out equipment isolation switch.

18. An equipment isolation switch assembly as claimed in claim 1 wherein lockout of the equipment isolation switch causes release of an additional type of actuating device selected from the group consisting of a key and equipment item for use in, or following, an isolation procedure.

19. An equipment isolation switch assembly as claimed in claim 18 wherein said actuating device removes a barrier preventing access to an equipment item under normal operating conditions.

20. A remote isolation system comprising a remote isolation station having an equipment isolation switch assembly as claimed in claim 1.

21. A remote isolation system as claimed in claim 20 comprising a control system for approving isolation on permissible request logged by an operator at said remote isolation station; and an input device co-operating with the equipment isolation switch for issuing isolation requests to a control system through a communication channel.

22. An equipment isolation switch assembly as claimed in claim 9 wherein at least one lock member rotates relative to a further lock member to form the isolation lockout point.

* * * * *